United States Patent [19]

Carsten

[11] 4,353,848

[45] Oct. 12, 1982

[54] FUEL/AIR METERING APPARATUS

[76] Inventor: Earl D. Carsten, 15421 Cameo Dr., Sun City, Ariz. 85351

[21] Appl. No.: 172,258

[22] Filed: Jul. 25, 1980

[51] Int. Cl.[3] ..... F02M 17/16

[52] U.S. Cl. ..... 261/69 R; 261/89; 261/44 E

[58] Field of Search ..... 261/88, 89, 69 R, 44 E

[56] References Cited

U.S. PATENT DOCUMENTS

| | | | |
|---|---|---|---|
| T896,009 | 9/1979 | Muller | 261/69 R |
| 958,897 | 5/1910 | Snedeker | 261/44 E |
| 1,140,232 | 5/1915 | Allen | 261/44 E |
| 1,178,127 | 4/1916 | Bricken | 261/88 |
| 1,190,714 | 7/1916 | Bottome | 261/64 A |
| 1,559,756 | 11/1925 | Kemp | 261/64 A |
| 2,604,309 | 7/1952 | Bruin | 261/69 R |
| 3,132,191 | 5/1964 | Kennedy, Sr. | 261/69 R |
| 3,298,335 | 1/1967 | Castelet | 261/69 R |
| 3,329,411 | 7/1967 | Offner | 261/39 A |
| 3,341,185 | 9/1967 | Kennedy, Sr. | 261/69 R |
| 3,348,824 | 10/1967 | Soubis | 261/69 R |
| 4,092,963 | 6/1978 | Vrooman | 261/69 R |
| 4,186,707 | 2/1980 | Driggers | 261/69 R |

FOREIGN PATENT DOCUMENTS

| | | | |
|---|---|---|---|
| 548594 | 1/1923 | France | 261/44 E |
| 128287 | 1/1927 | Switzerland | 261/44 E |
| 1021628 | 3/1966 | United Kingdom | 261/88 |

*Primary Examiner*—Tim R. Miles

*Attorney, Agent, or Firm*—Harry M. Weiss

[57] ABSTRACT

This disclosure relates to a fuel/air metering apparatus which incorporates a fuel valve responsive to variations in air flow as monitored by a vacuum diaphragm, an air metering apparatus having a plate rotatable about an axis generally parallel to the direction of airflow at the plate, and a vaporizing apparatus which enhances the vaporization rate of the fuel to serve as a device to meter fuel and air to an externally timed ignition internal combustion engine.

4 Claims, 8 Drawing Figures

FUEL/AIR METERING APPARATUS

BACKGROUND OF THE INVENTION

1. Field of the Invention

This invention relates generally to fuel and air metering devices, and, more specifically, to fuel and air metering devices used to effectively control the power output of an externally timed ignition internal combustion engine.

2. Description of the Prior Art

In the past, internal combustion engines have been utilized to provide a mechanical power source for a wide range of applications. Various types of induction apparatus have been developed to provide control over the power output of the engine. Included among those types of apparatus are carburetors and fuel injection systems, which heretofore have utilized a butterfly-type throttle valve to meter the air or the fuel/air mixture. The butterfly throttle valves rotated about an axis generally orthogonal to the direction of flow at the throttle. As the fluid passing the butterfly throttle was constricted through only two variable apertures, flow asymmetries often resulted. A need existed for an air or fuel/air mixture throttle apparatus having a plurality of flow passages to permit a more symmetric distribution of the flow passing the throttle apparatus.

Fuel combustion in an internal combustion engine is a chemical process occurring at the molecular level. Combustion occurs when molecules of fuel combine with molecules of oxygen to release heat. Optimal combustion requires that the liquid fuel be fully vaporized to a molecular state to be associated on a molecular level with oxygen molecules, and also requires that the fuel molecules be thoroughly mixed throughout the oxygen laden intake air. Failure to fully vaporize the fuel reduces engine efficiency and increases unwanted exhaust emissions. A need existed for an apparatus capable of enhancing the vaporization rate of liquid fuel and thoroughly mixing the vaporized fuel with the incoming air.

The fuel consumption rate of an externally timed ignition, such as laser or spark ignition, internal combustion engine has become a growing concern. The fuel consumption rate of an engine is in substantial part a function of the particular fuel/air induction system utilized. For example, when an engine is decelerating a load, as when braking a vehicle down a long grade, the induction systems of the past continued to meter a minimum quantity of fuel, as would be sufficient to maintain the normal engine idle. Since engine braking involves an absorbtion of power by and a dissapation of energy within the engine, the metering of even a minimal quantity of fuel into the engine reduces the power absorbtion and energy dissapation capacity of the engine. Additionally, under conditions where engine braking is desired, the fuel being metered into the engine by the induction system serves no useful purpose or function, and comprises a complete waste of fuel. A need existed for an induction system for an externally timed internal combustion engine capable of conserving fuel by curtailing fuel metering under engine braking conditions.

The mechanically operated induction systems of the past utilized a pressure differential between atmospheric pressure and an accelerated air flow through a venturi to meter fuel, a high pressure pump whose output was controlled by the degree of throttle plate rotation, or a series of high pressure pumps whose output was controlled by the degree of throttle rotation to meter fuel.

As each of these systems was expensive, a need existed for a low-cost vacuum controlled fuel metering system.

SUMMARY OF THE INVENTION

In accordance with one embodiment of this invention, it is an object to provide a fuel metering apparatus for an internal combustion engine.

It is another object to provide an air metering apparatus for an internal combustion engine providing symmetric distribution of incoming air.

It is a further object to provide an induction apparatus having a manifold vacuum responsive mechanically actuated fuel metering apparatus.

It is yet another object to provide an induction apparatus having a manifold vacuum controlled fuel metering system having a mechanically operated accelerator enrichment device.

It is still another objective to provide a fuel/air metering apparatus having a vaporization device to mechanically enhance the rate of vaporization of the fuel.

It is again another objective to provide an induction apparatus having a manifold vacuum actuated fuel shutoff to conserve fuel under conditions of engine braking.

It is still a further objective to provide an induction apparatus having an adjustably biased diaphragm to operate a fuel metering apparatus.

DESCRIPTION OF THE PREFERRED EMBODIMENTS

In accordance with one embodiment of this invention, a fuel/air metering system for an externally timed ignition internal combustion engine is disclosed, comprising: air metering means having an air conduit and a throttle plate rotatably mounted within the air conduit provided with at least a generally planar throttle plate surface and an axis of rotation perpendicular to the planar surface for controllably metering at least an airflow into the engine; fuel metering means having a diaphragm for controllably metering a flow of fuel into the airflow in response to intake manifold vacuum so that a fuel/air mixture flow is provided; and vaporizing means for mechanically inducing turbulence and swirl into the fuel/air mixture flow so that the fuel tends to vaporize.

In accordance with another embodiment of this invention, a method for metering fuel into an airflow into an externally timed internal combustion engine is disclosed comprising steps of: deflecting a diaphragm in response to intake manifold vacuum; rotating a valve to meter fuel; and controlling the rotation of the valve with the deflection of the diaphragm.

THE SPECIFICATION

Figure 1:
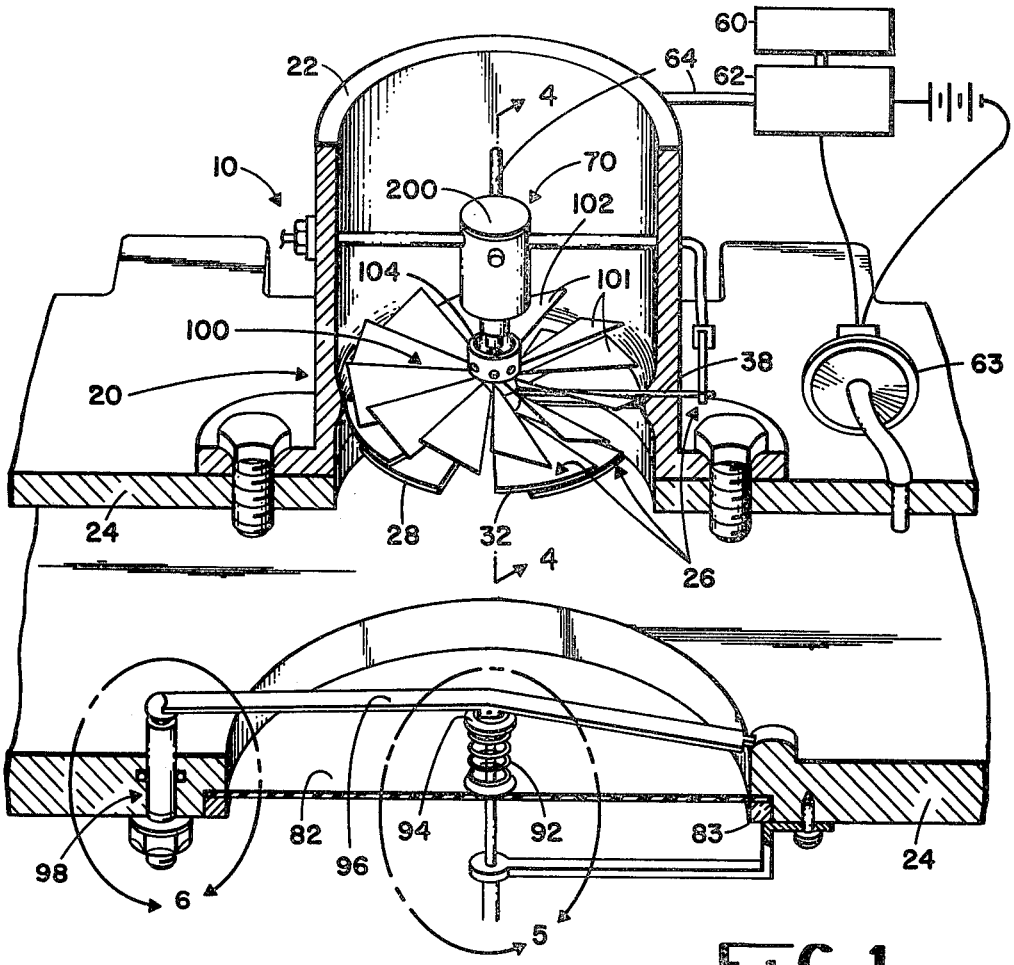
FIG. 1 is a elevational view of the herein disclosed fuel/air metering apparatus with portions removed for clarity.

Referring to FIG. 1, an elevational perspective view of an air/fuel metering system, or an induction apparatus, for an externally timed internal combustion engine is shown generally at reference number 10, with portions removed for clarity. The induction system 10 is provided with air metering means for controllably metering at least an airflow into the engine, fuel metering means for controllably metering a flow of fuel into the airflow as function of an intake vacuum drawn by the engine and vaporizing means, shown generally by reference number 100, for mechanically inducing swirl and turbulence into the combined air fuel mixture flow so that the fuel tends to vaporize.

Figure 2:
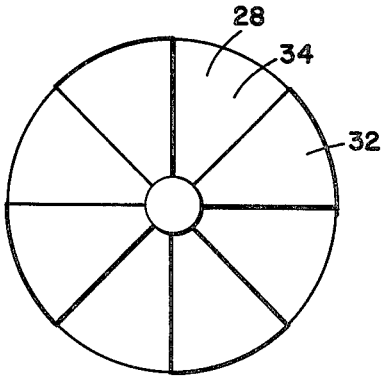
FIG. 2 is a top view of the throttle apparatus of FIG. 1 shown in a closed position.
Figure 3:
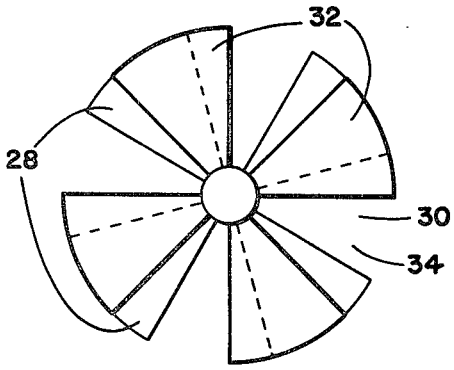
FIG. 3 is a top view of the throttle apparatus of FIG. 2 shown in a partly opened position.

The air metering means are provided with an air conduit, shown generally by reference number 20. The air conduit 20 is provided with an induction apparatus body 22 disposed to receive the incoming air from an aircleaner (not shown), and an intake manifold 24 which at least partially contains the inlet manifold vacuum drawn by the engine. The air metering means are also provided with a throttle apparatus shown generally by reference number 26 for regulating the flow of atmospheric air through the induction apparatus body 22 and toward the engine through the intake manifold 24. The throttle apparatus 26 is comprised of a throttle plate 28 having a generally planar surface 29 and a rotatable coupling to the induction apparatus body 22, and a baffle plate 32 having a generally planar surface 33 immediately adjacent to the throttle plate planar surface 29. The throttle plate 28 and the baffle plate 32 are each provided with at least an aperture as respectively shown by reference numbers 30, 34. The throttle plate aperture 30 and the baffle plate aperture 34 are preferably four in number and equally spaced. The air metering means are also provided with actuating means (refer also to FIG. 4) for rotating the throttle plate 28 in response to motion applied to an actuating shaft 38. At engine idle, or upon deceleration of the engine, the throttle plate 28 and the baffle plate 32 rest in a complementary relationship so that the throttle plate 28 seals each of the baffle plate apertures and allows only sufficient air to pass to maintain the idle (refer to FIG. 2). As the throttle plate 28 is rotated open, the throttle plate apertures 30 and the baffle plate apertures 34 progressively correspondingly coincide to allow higher pressure atmospheric air to enter the lower pressure, intake manifold 24 contained engine drawn vacuum (refer to FIG. 3). Opening the throttle plate apertures 30 to the baffle plate apertures 34 exposes the intake manifold 24 contained vacuum to atmospheric air causing the air flow into the engine, and hence increases the power output.

The vaporizing means 100 are shown in the embodiment 10 as being comprised of a rotor 101 having a plurality of rotor blades 102 which are symmetrically arranged about and individually coupled to a rotor body 104. The rotor body 104 is rotatably coupled to the induction apparatus body 22, for example by being rotatably mounted upon the baffle plate (refer also to FIG. 4). The rotor blades 102 each define a surface which is angularly disposed with respect to the direction of the fuel/air mixture flow in the region of the rotor 101. As the fuel/air mixture flow impinges upon the blades 102, the flow is deflected and rotor 101 is caused to turn, resulting in turbulence and swirl, causing any liquid fuel particles to be thoroughly mixed with the flowing air, thereby enhancing the rate of fuel vaporization.

The vaporizing means 100 are also provided with a distribution nut 106 (refer also to FIG. 7), which is effectively an extension of the rotor body 104. The nut 106 defines a concavity 108 which is provided with a plurality of distributor apertures 109 which lie in a generally common plane with the fuel outlet orifice 218. In operation, the fuel leaving the fuel outlet orifice 218 impinges the interior surface of the concavity 108 of the rotating nut 106, and is thereupon slung through the distributor apertures 109 into the airflow by the rotary motion of the nut 106, thereby tending to enhance the vaporization rate of the fuel.

Figure 4:
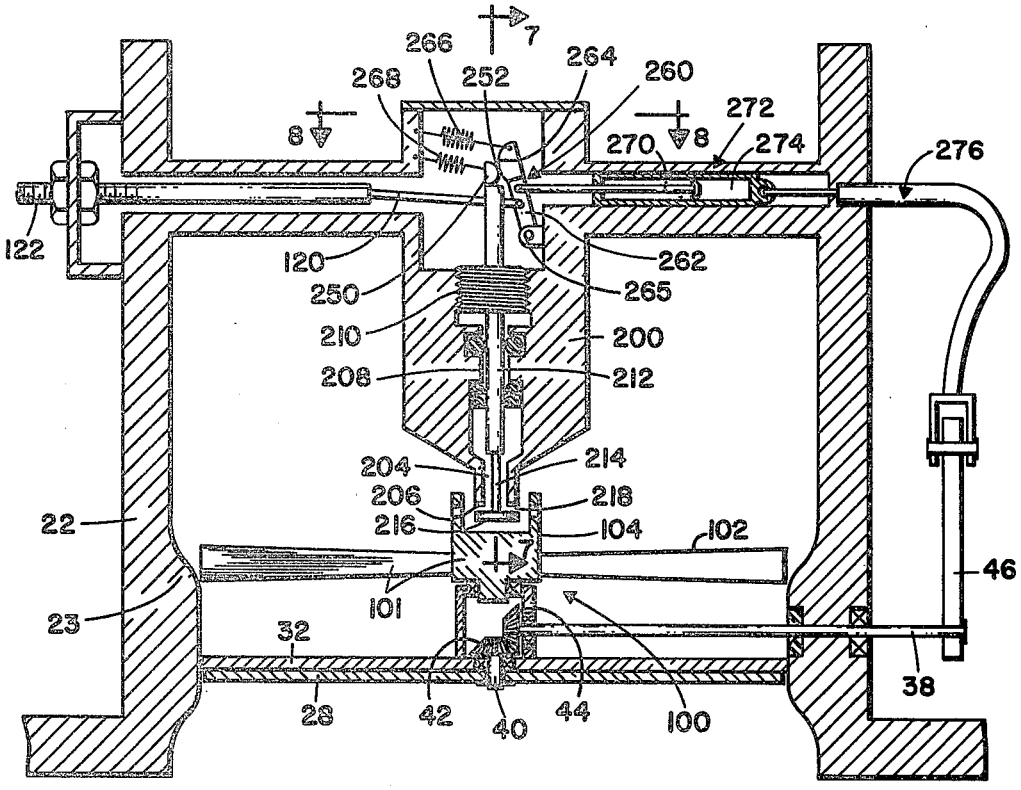
FIG. 4 is an enlarged sectional elevational view taken along line 4—4 of FIG. 1.

Referring also to FIG. 4, a sectional elevational view taken along line 2—2 of FIG. 1, the throttle plate 28 is shown fixedly mounted to a throttle plate shaft 40 which is rotatably coupled to the baffle plate 32 and hence to the induction body 22. A first bevel gear 42 is fixedly coupled to the throttle plate shaft 40, and a second bevel gear 44 is fixedly coupled to the actuating shaft 38 and drivably coupled to the first bevel gear 42, so that rotation of the actuating shaft 38, produced for example as a result of movement of one end of an operator actuated lever 46 coupled to an outer end of the actuating shaft 38, causes the throttle plate 28 to rotate.

As the power output of the engine is generally inversely proportional to the level of the intake manifold 24 contained vacuum, the fuel requirements of the engine (which are directly proportional to the air flow) are also approximately inversely proportional to the level of the intake manifold 24 contained vacuum. The fuel metering means of the embodiment 10 meters fuel into the air flow at a rate dependent upon the level of the intake manifold 24 contained vacuum. The fuel metering means are shown comprised of a fuel reservoir 60, an electrically operated fuel pump 62 for delivering fuel from the reservoir 60 at a regulable constant pressure output, a fuel distribution circuit shown generally by reference number 64, and fuel control valve means shown generally by reference number 70. The fuel metering means are also provided with a diaphragm 82 peripherally sealably coupled to the intake manifold 24, for example by a ring 83 and a plurality of threaded fasteners, and are further provided with linkage means for controllably operating the fuel control valve means 70 as a function of the displacement of the central portion of the diaphragm 82.

As the manifold vacuum is an absolute pressure below atmospheric pressure, the pressure differential tends to deflect the diaphragm 82. As the diaphragm 82 is peripherally fixedly coupled to the intake manifold 24, the only substantial deflection occurs at the interior portions of the diaphragm 82, and the greatest deflection occurs at the center of the diaphragm 82. The magnitude of the deflection is generally proportional to the level of vacuum encountered at any time in the operating cycle of the engine. The displacement of the diaphragm 82 varies as a function of a balance produced by the vacuum and a spring means acting against the vacuum. At idle speed, the engine draws a relatively high intake vacuum, for example 460 mm. to 510 mm. of Hg (18 in. to 20 in. of Hg).

The vaporizing means 100 of the embodiment 10 are shown as being further comprised of a venturi, shown generally by reference number 23. The venturi 23, in conjunction with the rotor 101, tends to create a vortex in the fuel/air mixture flow so that the vaporization rate is further enhanced.

Figure 6:
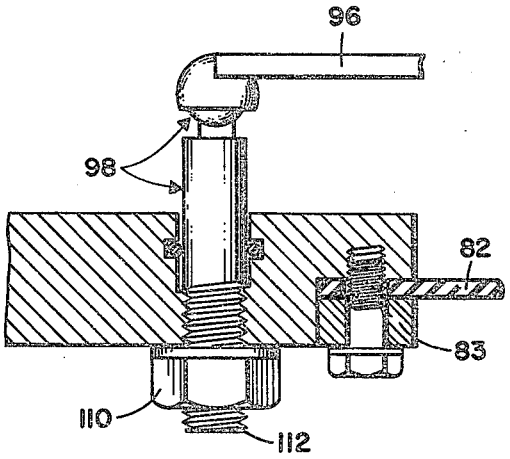
FIG. 6 is an enlarged sectional elevational view referenced from numeral 6 of FIG. 1.
Figure 5:
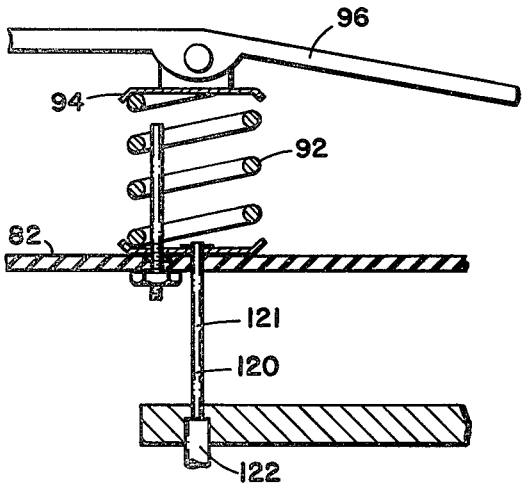
FIG. 5 is an enlarged sectional elevational view referenced from numeral 5 of FIG. 1.

Referring also to FIG. 5, an enlarged sectional elevational view referenced from numeral 5 of FIG. 1, the spring means are shown provided with a spring 92, which has a first end in communication with the vacuum side of the diaphragm 82, and has a second end in communication with a spring seat 94. The spring seat 94 is pivotally coupled to a medial portion of a spring tension adjusting arm 96. The adjusting arm 96 is pivotally coupled at a first end to the intake manifold 24, and is pivotally coupled at the opposite end to a tension adjusting screw apparatus, shown generally by reference number 98 (refer also to FIG. 6, an enlarged sectional elevational view referenced from numeral 6 of FIG. 1). The preload, or bias, created by the spring 92 against deflection of the diaphragm 82 can be adjusted by releasing a locknut 110 and shifting the position of tension adjusting screw 112, and resetting the locknut 110 when the proper fuel/air mixture is established. It will be apparent to one skilled in the art that the spring 92 could be advantageously progressively wound so that an optimal fuel/air mixture could be maintained over the entire power range of the engine, which range is functionally related to the range of intake manifold vacuum encountered during the operation of the engine.

The central portion of the diaphragm 82 is coupled to rotating means for controllably rotating the valve body 212 as a function of the displacement of the diaphragm 82. As shown in FIGS. 4 and 5, the rotating means are comprised of a control cable 120 which passes through a cable jacket 122. The cable jacket 122 has a first end fixedly coupled to the intake manifold 24 proximal to the diaphragm 82. The control cable 120 exits from a second end of the cable jacket 122 at a point near the induction apparatus body 22, passes through the wall of the induction apparatus body 22 and is thence coupled to a portion of the fuel control valve means. The cable jacket 122 is adjustably restrained near the induction apparatus body 22, for example by a pair of threaded fasteners, an externally threaded portion of the jacket 122, and an apertured, spaced plate so that the effective length of the cable 120 can be adjusted by shifting the cable housing 122.

Figure 7:
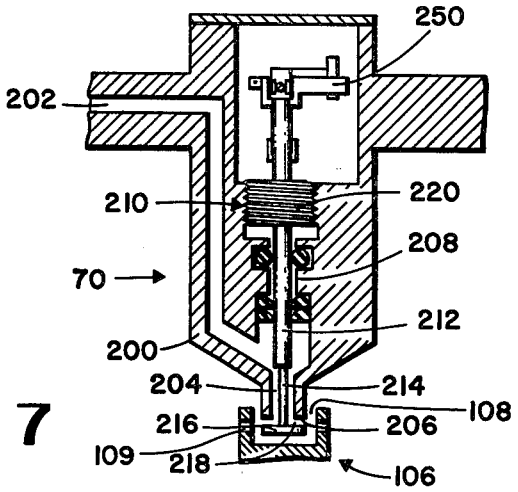
FIG. 7 is an enlarged sectional elevational view taken along line 7—7 of FIG. 4.
Figure 8:
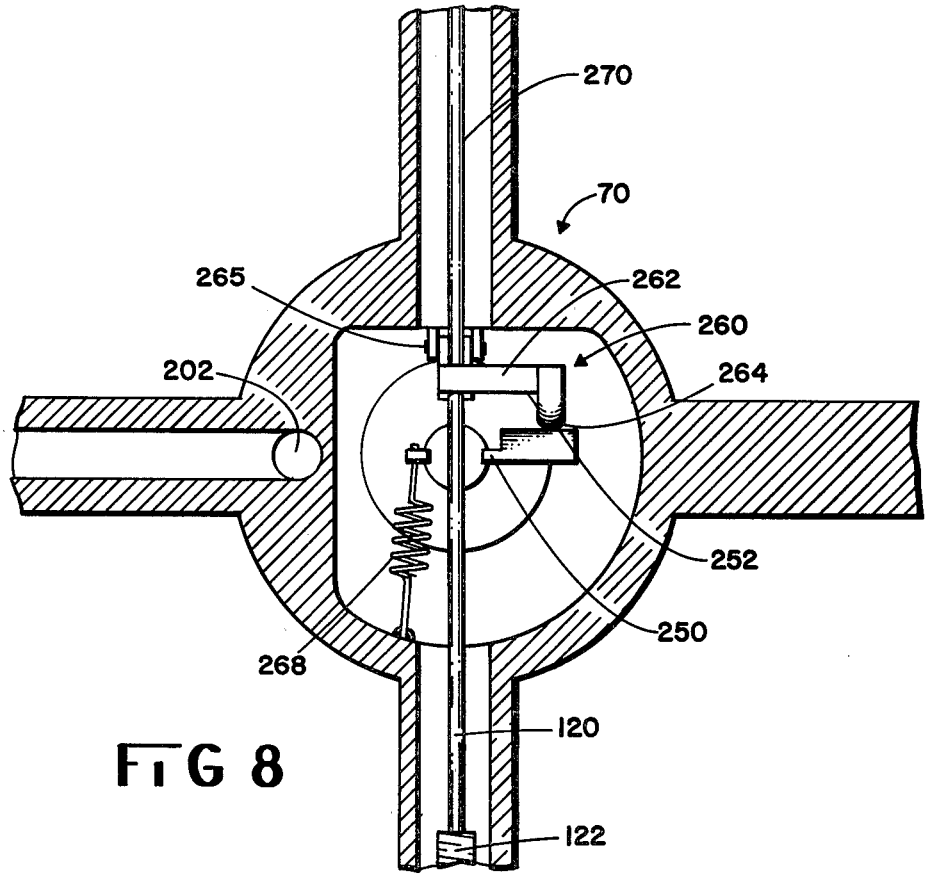
FIG. 8 is an enlarged sectional view taken along line 8—8 of FIG. 4.

Referring also to FIG. 7, an enlarged sectional elevational view taken along line 7—7 of FIG. 4, and to FIG. 8, a sectional view taken along line 8—8 of FIG. 4, it can be seen that the fuel control valve means are comprised of a valve housing 200, provided with an inlet aperture 202, a centrally disposed outlet aperture 204 which terminates in a valve seat portion 206, and a valve body aperture 208 disposed about a common axis with the outlet aperture 204 and the valve seat portion 206. The internal diameter of the valve body aperture 208 is provided with a threaded portion shown generally by reference number 210. The fuel control valve means are further comprised of a valve body 212, which is provided with a rod portion 214 which terminates in a valve head 216. The valve head 216 cooperates with the valve seat portion 206 of the valve housing 200 to form the variable area fuel outlet orifice 218 which meters the fuel. The valve body 212 is further provided with a threaded shank portion 220 which engages the threaded portion of the valve housing 210, and which valve body 212 terminates in the rotating means for controllably rotating the valve body 212 as a function of the displacement of the vacuum diaphragm 82.

The rotating means are comprised of the arm member 250 portion of the valve body 212, which arm member 250 is provided with a cam follower surface 252, and the cam means shown generally by reference number 260 for translating the cam follower surface 252 as a function of the displacement of the diaphragm 82. As shown, the cam means 260 are comprised of a finger member 262 which is provided with a cam surface 264 in communication with the cam follower surface 252, and also provided with a pivotal coupling 265 to the valve housing 200. The finger member 262 is also coupled to the cable 120, for example by a pin and a clevis. The cam means 260 are also preferably comprised of a cam spring 266 and a cam follower spring 268 which are respectively coupled between the finger 260 and the valve housing 200, and between the arm 250 and the valve housing 200 so that the cam surface 264 and the cam follower surface 252 are biased toward each other while the springs 266, 268 maintain an essentially neutral force condition upon the combination of the finger 260 and the arm 250.

In operation, the cam surface 264 can be contoured so that a non-linear relationship can be established between the various possible displacements of the diaphragm 82 and the various possible degrees of rotation of the valve body 212 (corresponding to the various possible rates of fuel flow). In this manner, the rate of fuel flow can be controlled to be exactly proportional to the airflow so that optimal efficiency can be maintained, and the engine permitted to be advantageously operated over a broad power range.

It will be apparent to one skilled in the art that an alternate rotation means could incorporate the cable 120, having a first end 121 which is coupled to the central portion of the diaphragm 82, and having the other end coupled directly to the arm member 250 in an eccentric relationship to the axis of the valve body 212 so that a change in the displacement of the diaphragm 82, as a result of a change in the level of vacuum, directly causes the end of the arm member 250 to move. Movement of the arm 250 causes the valve body 212 to rotate to adjust the area of the fuel outlet orifice 218 to change the rate of fuel flow to maintain the proper proportion with regard to the changed level of vacuum and rate of airflow. While the simplicity of the direct coupling of the cable 120 to the valve body arm member 250 can be advantageous, the non-linear relationship between the power output and the vacuum caused displacement of the diaphragm 82 will generally limit the application of such a rotating means to applications where the range of power output required from the engine, and hence the range of diaphragm 82 displacements, is narrow.

Under steady state loading, typical intake vacuum levels range from 250 mm. to 460 mm. of Hg (10 in. to 18 in. of Hg), while under full power conditions the vacuum level can fall to levels less than 25 mm. of Hg (1 in. of Hg).

An incremental opening of the throttle plate 28 establishes an increased rate of flow of the fuel/air mixture into the intake manifold 24. The initial flow rate and subsequent flow rate are separated by a pressure gradient, which gradient coincidentially separates the lower vacuum (higher flow rate) region from the higher vacuum (lower flow rate) region. As the pressure gradient propogates as a wave from the throttle plate 28, a substantial pulse of lean mixture, wherein the air is being metered at an increased rate but fuel is being metered at the initial flow rate, can enter the intake manifold 24 before the pressure gradient reaches the diaphragm 82, and thereby effects an increase in the rate of fuel flow in response to the lower level of vacuum. To eliminate a "lean spot" upon opening the throttle plate 28, the rotating means of the fuel metering means are further preferably provided with accelerator enrichment means for temporarily rotating the valve body 212 an incremental amount in response to a rotation of the throttle plate in an open direction. As shown in FIGS. 4 and 8, the accelerator enrichment means are comprised of a translating member 270 having a coupling to the finger 262 so that, at least where rotational displacements of the finger 262 are small, the rotational position of the cam surface 264 and the linear position of the translating member 270 are approximately directly proportional. The translating member 270 is coupled to damper means shown generally by reference number 272. The damper means 272 are coupled to the lever 46 and hence to the throttle plate 28, and function by temporarily displacing the translating member 270 a distance approximately proportional to the rate at which the throttle plate 28 is opened. The damper means 272 can be a single direction damped hydraulic cylinder 274 and a housed cable connection to the lever 46, shown generally by reference number 276, so that closing the throttle plate 28 has no effect upon the position of the cam surface 264, while opening the throttle plate 28 temporarily displaces the cam surface 264 a distance proportional to the rate at which the throttle plate 28 was opened. The described temporary displacement of the cam surface 264 incrementally tensions the spring 268 and also shifts the cable 120 and the diaphragm 82 against the compression of the spring 92.

The highest level of vacuum, in the range of 630 mm. to 710 mm of Hg (25 in. to 28 in. of Hg), is reached when the engine is decelerating a load. Since such selective braking is a salutary function, continued injection of fuel at the rate required for idle not only undesirably reduces the engine braking capability, but also constitutes a waste of fuel. The fuel metering means are accordingly preferably additionally provided with shutoff means for terminating the fuel flow when the manifold vacuum exceeds a particular vacuum level. The shutoff means are comprised of, for example, a vacuum operated normally closed switch 63 which opens the electrical circuit powering the electric fuel pump 62 when the vacuum level reaches the particular level, which is typically 630 mm. of Hg (25 in. of Hg).

While the invention has been particularly described and shown in reference to the preferred embodiments thereof, it will be understood by those skilled in the art that various changes in form and detail and omissions may be made therein without departing from the spirit and scope of the invention.

I claim:

1. A fuel/air metering system for an externally timed ignition internal combustion engine, comprising:

air metering means having an air conduit and a throttle plate rotatably mounted within said air conduit provided with at least a generally planar throttle plate surface and an axis of rotation perpendicular to said planar surface for controllably metering at least an airflow into the engine;

fuel metering means having a diaphragm for controllably metering a flow of fuel into said airflow in response to intake manifold vacuum so that a fuel/air mixture flow is provided;

vaporizing means for mechanically inducing turbulence and swirl into said fuel/air mixture flow so that said fuel tends to vaporize;

said fuel metering means further comprising said diaphragm having a first surface in communication with said intake manifold vacuum and a second surface in communication with atmospheric pressure;

said fuel metering means further comprising a pump for pumping a flow of said fuel under pressure from the fuel reservoir;

said fuel metering means further comprising fuel control valve means at least partly in communication with said air conduit having a rotatable valve body for controllably restricting the rate of entry of said fuel flow into said airflow;

said fuel metering means further comprising rotating means in communication with said diaphragm and said valve body for rotating said valve body as a function of at least a displacement of said diaphragm;

said fuel control valve means further comprising said valve body having a metering rod portion provided with a valve head at a first end and a threaded portion;

said fuel control valve means further comprising a valve housing coupled to said air conduit having a fuel inlet aperture, a fuel outlet aperture concentrically disposed about said metering rod portion of said valve body, a valve seat at the terminus of said fuel outlet aperture so that said valve seat and said valve head cooperatively define a valve orifice, and a valve body aperture having at least a portion threadedly engaged to said valve body threaded portion so that rotating said valve body produces a longitudinal translation of said valve body within said valve housing tending to vary the area of said valve orifice;

said rotating means comprising said valve body having an arm member;

said rotating means further comprising first means having a cable provided with a diaphragm end coupled to said portion of said diaphragm for transferring said displacement of said portion of said diaphragm to said arm member so that said valve body can be rotated thereby;

said rotating means further comprising said arm member having a cam follower surface; and said rotating means yet further comprising said cable means having cam means having a cam surface in communication with said cam follower surface for translating said cam follower surface as a function of said displacement of said diaphragm.

2. A system in accordance with claim 1 wherein said cam means further comprising a finger coupled to said cable and having said cam surface and a pivotal coupling to said valve housing.

3. A system in accordance with claim 2 wherein said rotating means further comprising accelerator enrichment means for temporarily rotating said valve body an incremental amount in response to a rotation of said throttle plate in an open direction.

4. A system in accordance with claim 3 wherein said enrichment means comprising:

a coupling in communication with said finger having a translating member whose position is always generally proportional to the pivotal displacement of said finger; and damper means in communication with said lever for temporarily displacing said translating member a distance proportional to the rate at which said throttle plate is rotated open.

* * * * *